US007374643B2

(12) United States Patent
Karimzadeh et al.

(10) Patent No.: US 7,374,643 B2
(45) Date of Patent: May 20, 2008

(54) COMPOSITE SACRIFICIAL ANODES

(75) Inventors: Hossein Karimzadeh, Cheshire (GB); Timothy E. Wilks, Bury (GB)

(73) Assignee: Magnesium Elektron Limited, Salford Quays, Manchester (GB)

( * ) Notice: Subject to any disclaimer, the term of this patent is extended or adjusted under 35 U.S.C. 154(b) by 171 days.

(21) Appl. No.: 10/534,895

(22) PCT Filed: Nov. 14, 2003

(86) PCT No.: PCT/GB03/04968

§ 371 (c)(1),
(2), (4) Date: May 13, 2005

(87) PCT Pub. No.: WO2004/046422

PCT Pub. Date: Jun. 3, 2004

(65) Prior Publication Data

US 2006/0035540 A1 Feb. 16, 2006

(30) Foreign Application Priority Data

Nov. 15, 2002 (GB) ..... 0226706.0
May 1, 2003 (GB) ..... 0310021.1

(51) Int. Cl.
*C23F 13/10* (2006.01)

(52) U.S. Cl. ..... 204/196.34; 204/196.17; 204/196.18; 204/196.19; 204/196.2; 204/196.21; 204/196.3; 204/196.33; 204/196.36; 29/746

(58) Field of Classification Search ..... 204/196.2, 204/196.21, 196.24, 196.33, 196.34, 196.36, 204/196.3, 196.17, 196.18, 196.19; 29/746
See application file for complete search history.

(56) References Cited

U.S. PATENT DOCUMENTS 2,508,171 A 5/1950 Kaufman (Continued)

FOREIGN PATENT DOCUMENTS

EP 0 219 472 4/1987

(Continued)

OTHER PUBLICATIONS

Juarez et al., "Improving the Efficiency of Magnesium Sacrificial Anodes", Jom, Minerals, Metals and Materials Society, Warrendale, US, Sep. 1993, vol. 45 No. 9, pp. 42-44.

(Continued)

*Primary Examiner*—Bruce F. Bell
(74) *Attorney, Agent, or Firm*—Pearne & Gordon LLP

(57) ABSTRACT

The invention relates to composite sacrificial anodes, particularly but not exclusively, based on magnesium, and to methods for their production. The composite sacrificial anode (10) for immersion in a corrosive environment comprises a plurality of castings (12) of a sacrificial material each disposed around a corresponding electrical connector for attachment to a structure to be protected, at least a part of the surface of each segment (12) being protected from corrosion by the environment by being adjacent at least one other segment (12), wherein the castings are connected together electrically only via their electrical connectors. A method of producing a composite sacrificial anode for immersion in a corrosive environment is also described, the anode (10) having an electrical connection for attachment to the structure to be protected, which method comprises casting a plurality of segments (12) of a sacrificial material each in contact with a corresponding electrical connector, each connector being at least partly within its corresponding individual segment (12), and electrically connecting the segments together only via their electrical connectors.

28 Claims, 2 Drawing Sheets

U.S. PATENT DOCUMENTS

| | | | | |
|---|---|---|---|---|
| 2,666,027 | A | 1/1954 | Vallett | |
| 2,838,453 | A | 6/1958 | Randall | |
| 2,947,680 | A | 8/1960 | Preiser | |
| 3,616,422 | A * | 10/1971 | Doremus et al. | 204/196.15 |
| 3,994,795 | A | 11/1976 | Kurr | |
| 4,699,703 | A | 10/1987 | Norman | |
| 5,294,396 | A | 3/1994 | Dressel et al. | |
| 5,910,236 | A | 6/1999 | Iossel et al. | |
| 6,461,082 | B1 * | 10/2002 | Smith | 405/211.1 |

FOREIGN PATENT DOCUMENTS

| | | |
|---|---|---|
| GB | 1 499 522 | 2/1978 |
| GB | 2 050 427 | 1/1981 |
| GB | 2 221 225 | 1/1990 |

OTHER PUBLICATIONS

Kim et al., "Advanced MG-MN-CA Sacrificial Anode Materials for Cathodic Protection", Materials and Corrosion, Feb. 2001, vol. 52 No. 2, pp. 137-139.

UK Search Report dated Aug. 19, 2003 (GB 0 310 021.1).

UK Search Report dated Jan. 21, 2003 (GB 0 226 706.0).

* cited by examiner

COMPOSITE SACRIFICIAL ANODES

The invention relates to composite sacrificial anodes, particularly but not exclusively, based on magnesium, and to methods for their production.

Magnesium or magnesium alloy sacrificial anodes have been used for many years to provide cathodic corrosion protection for iron and steel engineering products, particularly in the oil industry. This technique is used to protect pipelines, marine oil installations, ships and other large steel constructions which are exposed to a corrosive environment such as the sea or wet ground.

The anode is immersed in the corrosive environment and is electrically connected to the structure to be protected either by physical attachment or through an electrical connection such as a cable or conductive bolt or strap.

The corrosion protection provided by the anode can be measured in two ways: the potential (voltage) of the anode, and the output capacity of the anode measured as amp-hours per kilogram of the sacrificial magnesium alloy.

There are at present three commonly used magnesium alloys that meet ASTM B843-93, namely (a) magnesium with 0.5-1.3% by weight manganese which produces a voltage of 1.7V, (b) magnesium with 5.3-6.7% by weight aluminium, 2.5-3.5% by weight zinc and 0.15-0.7% by weight manganese, and (c) magnesium with 2.5-3.5% by weight aluminium, 0.6-1.4% by weight zinc and 0.2-1.0% by weight manganese, both (b) and (c) producing a voltage of 1.5V.

The output capacity is affected by both the alloy used and by the method of manufacture of the anode. In particular, the cooling rate of the metal during solidification has been found to be important. (Juarez-Islas et. al 1993). The theoretical value for the output capacity for magnesium alloys is 2400 Ahr/kg. However it is reported that typical anodes are only 30-35% efficient.

The present invention will be described with reference to the accompanying drawings, in which.

Figure 1:
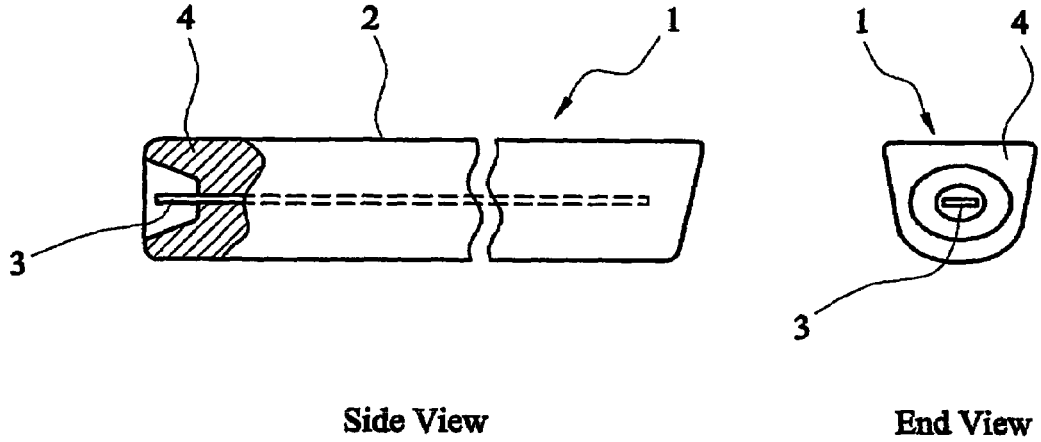
FIG. 1 shows a side view and an end view of a conventional anode.

Currently, cast magnesium anodes are 'D' shaped and are of the type shown in accompanying FIG. 1. The anode (1) is manufactured by casting a sacrificial magnesium alloy (2) around a centrally placed steel insert (3) laid horizontally in an open top permanent mould, usually manufactured of cast iron. The insert (3) provides both the mechanical and the electrical connection between the anode (1) thus formed and the structure to be protected (not shown). A bitumen mastic (4) is coated over the end of the anode (1), where the insert (3) protrudes from the alloy (2) in order to avoid premature corrosion of the sacrificial alloy (2) in the region of its junction with the insert (3). The 'D' shape cross-section facilitates removal of the casting from the mould. This conventional method of manufacture typically results in a variable metal cooling rate both within individual anodes, and between anodes within a batch. In the case of large anodes, i.e. greater than 10 kg, or very large anodes i.e. greater than 100 kg, for example in the region of 5 tonnes, the solidification rate in the centre of the anode will be substantially lower than that at the edge. This results in the electrochemical efficiency of conventional anodes being both poor and variable.

This invention relates to sacrificial anodes, particularly of magnesium or a magnesium alloy, which have improved performance with respect to output capacity, especially for large and very large anodes.

This is achieved by effectively dividing up a large anode into smaller parts, each of which is preferably produced under carefully controlled conditions. Each part of such composite anode is arranged to function on its own, but together the parts behave as a single anode. The parts must be joined together in such a way that their corrosion takes place essentially only on their outermost exposed surfaces. In particular it should be ensured that there is no premature corrosion of the sacrificial material in the region of its electrical connection with the structure to be protected before the material remote from that connection has been corroded, particularly when the electrical connection is offset in the material, i.e. not centrally placed.

U.S. Pat. No. 5,294,396 describes a segmented anode for direct attachment to a pipeline to be protected.

By contrast the anodes of the present invention are connected electrically to the structure to be protected only indirectly through their electrical connection without the sacrificial material of the anodes being in direct electrical contact with the structure.

In accordance with the present invention there is provided a composite sacrificial anode for immersion in a corrosive environment comprising a plurality of castings of a sacrificial material each disposed around a corresponding electrical connector for attachment to a structure to be protected, a part of the surface of each segment being protected from corrosion by the environment by being adjacent at least one other segment, wherein the castings are connected together electrically only via their electrical connectors.

By being connected via their electrical connector to the structure to be protected, each casting behaves as a part or segment of a large composite anode. Physical but non-electrical connection between the composite anode and the structure to be protected can be provided by means of cables, straps, adhesives or the like as required.

Preferably each electrical connector extends into its corresponding casting in the casting direction, and the sacrificial material of each casting is protected from external corrosion in the region of its attachment to its connector.

The present invention also provides a method of producing a composite sacrificial anode for immersion in a corrosive environment and having an electrical connection for attachment to the structure to be protected, which method comprises casting a plurality of segments of a sacrificial material each in contact with a corresponding electrical connector, each connector being at least partly within its corresponding individual segment, and electrically connecting the segments together only via their electrical connectors.

The segments of the composite anode can be grouped together in a variety of different arrangements, such as in a chain or circle, but in order to maximise the life of the composite anode the segments are preferably arranged in the form of a block in which each segment is adjacent at least two other segments. Electrical insulation between adjacent segments can be provided by spacing them apart or by the interposition of an insulating layer, such as a surface coating of insulating resin or mastic. The external shape of the composite anode can be cubic, rectangular, cylindrical or any other regular or irregular solid shape, depending upon the particular corrosion environment into which the anode is intended to be immersed, especially if it is required to fit into or around the structure which it is intended to protect. The shape of each segment can be varied in accordance with the solid shape of the composite anode and the shape of adjacent segments. Suitable segment shapes are cubes, rectangles, sectors and cones.

Each electrical connector is preferably substantially straight and fully aligned with the casting direction of its segment, although some deviation is possible. Each connector is generally smooth, although some roughening, ridges, grooves and the like may be helpful for facilitating good electrical and physical connection with the sacrificial material. An individual connector may also take the form of a plurality of separate connectors embedded in the same casting.

In a preferred embodiment of the present invention a waterproof mastic or resin is used to coat the surfaces of the segments around their exposed connectors, where the connectors are on or near the surface of the segments. Preferably each segment is identical and is assembled together with the other segments to form a composite anode in the form of a block, with any gaps between the segments being filled with an electrically insulating waterproof mastic or resin to prevent corrosion of the interior of the composite anode. Conveniently in such an arrangement the individual connectors are cast in an off-centre position in each segment; so that when assembled together their connectors are close together and thus easier to join.

It is preferred that there are no voids within the composite anode, i.e. the segments extend substantially to the centre of the anode, with any internal spaces between the segments being filled with the mastic or resin.

By providing each of the segments with its own electrical connector and by arranging for those individual electrical connectors to be joined, an electrical pathway between each anode segment and the structure to be protected is ensured throughout the corrosion life of each segment.

Additional physical connections can be provided between the different segments, such as by strapping them together with one or more bands, but any such additional connections must be non-electrical and must not allow the formation of voids between the segments into which the corrosive environment could ingress during the corrosion of the composite anode. The waterproof mastic or resin should therefore fill any gaps, preferably totally, between these segments so that even when segments are well corroded their further corrosion continues to take place essentially only on their outermost surfaces and not between them. Generally an electrically insulating mastic or resin is used, such as pitch or a polyurethane resin.

In the most preferred embodiment of the present invention each segment, of preferably a magnesium or magnesium alloy, is cast using direct chill (DC) casting technology. This is a method of manufacture currently used to produce magnesium slabs or billets as described in, for example, Grandfield, J. and McGlade, P. "DC Casting of Aluminium: Process Behaviour Magnesium Technology", Materials Forum Australia, Volume 20, 1996, p. 29-51. The preferred casting method is a modification of this known production method which allows for the introduction of a conductive insert into the cast magnesium or magnesium alloy billet or slab so as to produce an anode. This is shown schematically in FIG. 3, and, as will be described in more detail hereinafter, each insert is preferably positioned off-centre near one of the walls of the mould and aligned with the casting direction.

Each off-centre insert, which is preferably a galvanised straight smooth mild steel bar, protrudes from its respective casting so that when the segments of the composite anode are assembled together their respective inserts can be joined together to provide both a mechanical and an electrical connection to the structure to be protected. Generally the protruding ends of the inserts are welded together and joined to a main connector, such as a cable clamp, which is integral with or else attached to the inserts, for example by welding, so as to provide the electrical connection to the structure to be protected.

One embodiment of the present invention will now be described by way of example with reference of accompanying FIGS. 2 and 3.

The composite anode (10) is in the form of a rectangular block of a square cross-section and is composed of four rectangular segments (12) of square cross-section fitted together in the form of a block. Each segment (12) has been formed by continuously casting a sacrificial magnesium alloy as will be described later. In order to prevent corrosion of the interior of the anode (10), the adjacent surfaces of the segments (12) are coated with an insulating mastic or resin (14) before being assembled together to form the block. The four segments (12) are arranged close together but are not directly touching along their lengths inside the anode (10). Each segment (12) is provided with an insert in the form of a steel bar (17 in FIG. 3) which extends through the whole length of its respective segment and to just beyond both end surfaces of its respective segment (12). The bars are off-set and all four bars are joined together where they are exposed or protrude from their segments by welding.

To one of the welded junctions a cable connector (15) is welded, and at both ends of the joined segments the welded junctions are covered by additional mastic (14*a*) with only the cable connector (15) exposed. An electrical wire or cable (not shown) is then attached to the exposed cable conductor (15) for connecting the composite anode (10) to the structure to be protected (not shown).

Figure 3:
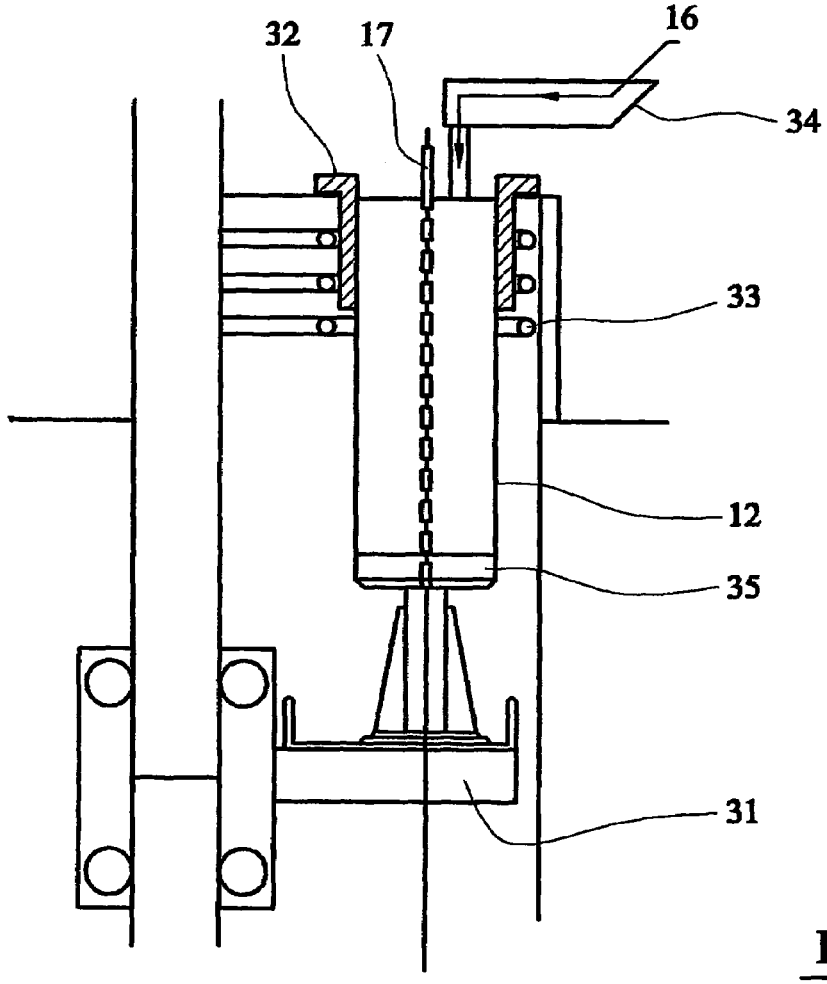
FIG. 3 is a schematic side view of a casting apparatus suitable for forming a segment of the anode of FIG. 2.
Figure 2:
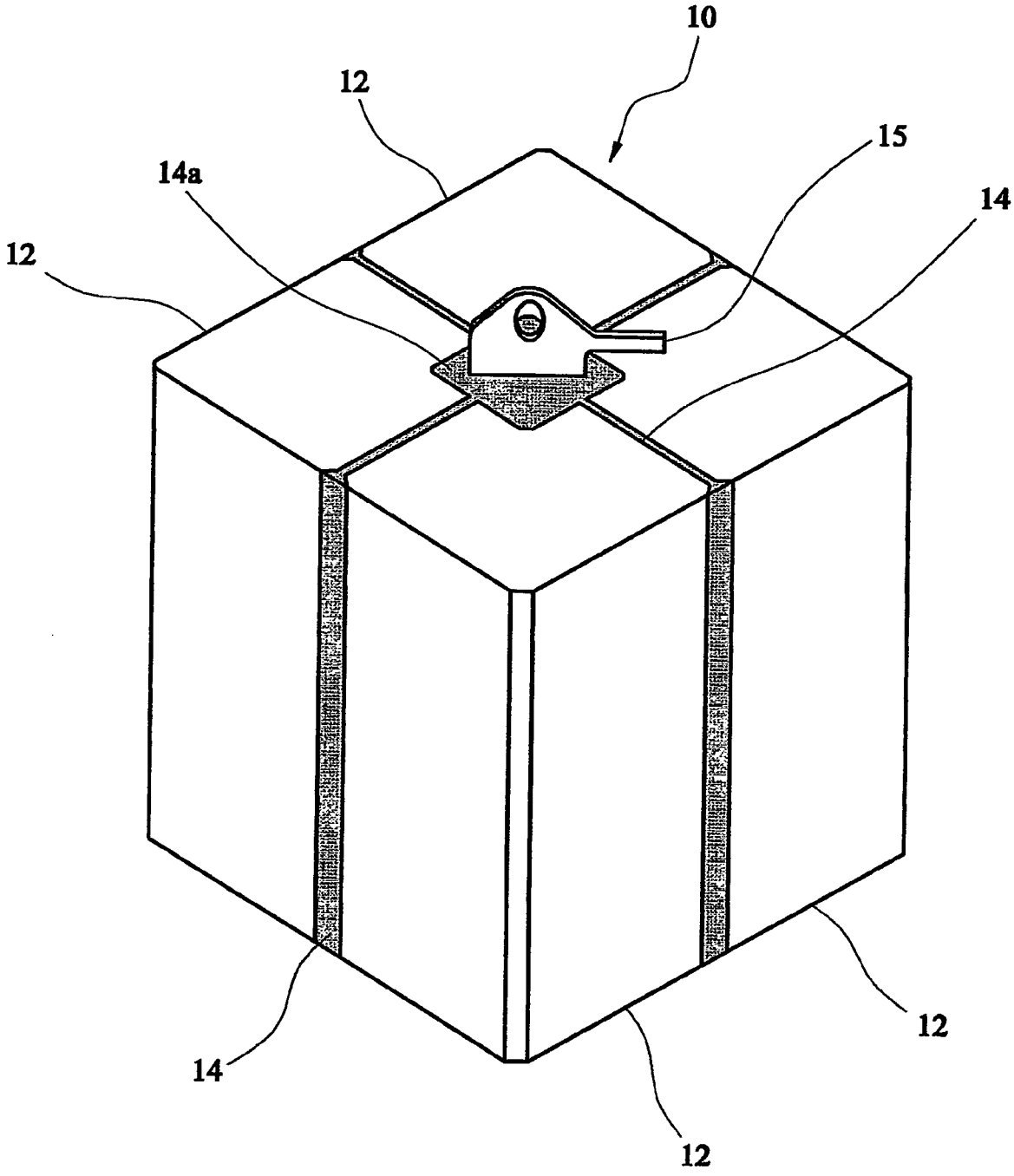
FIG. 2 is perspective view of a composite anode of the present invention.

Referring to FIG. 3, the apparatus for continuously casting the segments (12) of FIG. 2 comprises a conventional movable casting platform (31) with its mould (32) and water spray rings (33) arranged in a conventional manner for DC casting.

The molten sacrificial magnesium alloy (16) is fed to the mould by reservoir (34). The molten metal is cooled under controlled conditions by the water emitted from spray rings (33) whilst the casting platform (31) is lowered to form the cast segment (12).

In order to provide the electrical connection for each cast segment (12) a ridged steel insert (17) is held vertically within the mould (32) so that the alloy (16) is cast around the bar (17). The bar (17) is located off-centre but aligned with the casting direction so as to facilitate its joining with the other bars of the other segments (12) as shown in FIG. 2.

In order to be able to join together the respective ends of the four bars (17) of the four segments (12) the bar (17) which is shown being cast in FIG. 3 protrudes slightly out of the base of the movable mould (35) and is also left protruding out of the top of the segment (12) after casting has been completed.

The use of this DC casting method for the segments (12) enables a uniform, controllable and rapid cooling process to be applied to each segment by the controlled direct cooling of the casting with a water spray. This results in an improved electrochemical efficiency for the composite anode over a permanent mould cast anode of the same size.

Table 1 sets out the typical output capacity from a conventionally cast anodes compared to that from anodes produced by DC casting.

TABLE 1

Typical energy capability of conventionally vs. DC cast anodes.

| Anode type | Energy capability(Ahr/Kg) |
|---|---|
| Conventionally Cast | 700-1000 |
| DC cast | 1200-1700 |

The present invention is particularly suitable for fabricating very large anodes, e.g. in the region of 5 tonnes. By combining two or more anode sections together the composite behaves as one large anode. The sections used in the composite may be produced by DC casting or by conventional permanent mould casting. In either case, the fabricated anode produces an improved electrochemical efficiency over a single permanent mould cast anode of the same size since the cooling and solidification rates of the individual segments are faster and more controlled than would be the case if the anode were cast in one piece.

By linking the inserts of each segment together and sealing the spaces between them using preferably pitch, the composite anode is caused to corrode from the outside only, and hence provides an electrical voltage and current flow equivalent to a single block anode.

The invention claimed is:

1. A composite sacrificial anode for immersion in a corrosive environment comprising a plurality of castings of a sacrificial material each disposed around a corresponding electrical connector for attachment to a structure to be protected, a part of the surface of each casting being protected from corrosion by the environment by being adjacent to at least one other casting, wherein the castings are connected electrically together only via their respective electrical connectors, wherein the composite anode has a weight greater than 10 kg and wherein the castings are joined together by a waterproof mastic or resin.

2. An anode as claimed in claim 1 wherein composite anode is in the form of a block.

3. An anode as claimed in claim 2 wherein the block is circular, square or rectangular in cross-section.

4. An anode as claimed in claim 1 whose weight is greater than 100 kg.

5. An anode as claimed in claim 1 wherein the waterproof mastic or resin coats the surface of each casting around its electrical connector.

6. An anode as claimed in claim 1 wherein each electrical connector is substantially straight.

7. An anode as claimed in claim 1 wherein the mastic or resin completely fills any gaps between the castings.

8. An anode as claimed in claim 1 wherein the castings are identical.

9. An anode as claimed in claim 1 when composed of between two and six castings.

10. A composite sacrificial anode for immersion in a corrosive environment comprising a plurality of castings of a sacrificial material each disposed around a corresponding electrical connector for attachment to a structure to be protected, a part of the surface of each casting being protected from corrosion by the environment by being adjacent to at least one other casting, wherein the castings are connected electrically together only via their respective electrical connectors, wherein the composite anode has a weight greater than 10 kg, and wherein the sacrificial material is an alloy consisting essentially of magnesium and from 0.15 to 1.3% by weight of manganese.

11. A method of producing a composite sacrificial anode for immersion in a corrosive environment and having an electrical connection for attachment to the structure to be protected, which method comprises casting a plurality of segments of a sacrificial material each in contact with a corresponding electrical connector, each connector being at least partly within its corresponding individual segment, assembling the segments together to form a composite anode such that a part of the surface of each segment is protected from corrosion by the environment by being adjacent to at least one other segment, and electrically connecting the segments together only via their electrical connectors, wherein the weight of the composite anode its greater than 10 kg and wherein the castings are joined together by a waterproof mastic or resin.

12. A method as claimed in claim 11 wherein the composite anode is in the form of a block.

13. A method as claimed in claim 12 wherein the block is circular, square or rectangular in cross-section.

14. A method as claimed in claim 11 wherein the weight of the composite anode is greater than 100 kg.

15. A method as claimed in claim 11 wherein the waterproof mastic or resin is arranged to coat the surface of each segment around its electrical connectors.

16. A method as claimed in claim 11 wherein each electrical connector is substantially straight.

17. A method as claimed in claim 11 wherein the mastic or resin completely fills any gaps between the castings.

18. A method as claimed in claim 11 wherein each segment is identical.

19. A method as claimed in claim 11 wherein the anode is composed of between two and six segments.

20. A method as claimed in claim 11 wherein each segment is formed by continuous casting.

21. A method as claimed in claim 20 wherein each segment is forcibly cooled.

22. A method as claimed in claim 21 wherein the cooling is effected by water.

23. A method as claimed in claim 11 wherein the casting is effected by direct chill casting.

24. A method of producing a composite sacrificial anode for immersion in a corrosive environment and having an electrical connection for attachment to the structure to be protected, which method comprises casting a plurality of segments of a sacrificial material each in contact with a corresponding electrical connector, each connector being at least partly within its corresponding individual segment, assembling the segments together to form a composite anode such that a part of the surface of each segment is protected from corrosion by the environment by being adjacent to at least one other segment, and electrically connecting the segments together only via their electrical connectors, wherein the weight of the composite anode is greater than 10 kg and wherein the sacrificial material is an alloy consisting essentially of magnesium and from 0.15% to 1.3% by weight of manganese.

25. A composite sacrificial anode for immersion in a corrosive environment, comprising at least two casting segments comprised of sacrificial material, an electrical connector at least partly within each corresponding casting segment for attachment to a structure to be protected, each casting segment including exterior surfaces and at least one interior surface, each said interior surface of each said casting segment being spaced apart from said interior surface of another said casting segment forming a gap therebetween, wherein said gap is sufficiently small effective to protect said interior surfaces from corrosion by the environment, an electrically insulating waterproof layer being disposed in each of said gaps, and said electrical connectors of each of the casting segments are connected electrically together.

26. An anode as claimed in claim 25 wherein a weight of said anode exceeds 100 kg.

27. An anode as claimed in claim 25 wherein said anode is comprised of between two and six casting segments.

28. An anode as claimed in claim 25 wherein the sacrificial material is an alloy consisting essentially of magnesium and from 0.15% to 1.3% by weight of manganese.

* * * * *